United States Patent [19]

McClure

[11] Patent Number: 4,718,623

[45] Date of Patent: Jan. 12, 1988

[54] BOTTLE SLING FOR HOLDING A BABY BOTTLE WHILE TRAVELING

[76] Inventor: Alice M. McClure, 5982 SW. Harrington, Lake Grove, Oreg. 97035

[21] Appl. No.: 870,830

[22] Filed: Aug. 25, 1986

[51] Int. Cl.[4] ..... A47D 15/00

[52] U.S. Cl. ..... 248/102; 248/205.2

[58] Field of Search ..... 248/102, 103, 104, 205.2, 248/305.1, 317; 224/148, 202, 251, 257, 275; 24/306; 52/DIG. 13; 297/DIG. 6; 128/DIG. 15

[56] References Cited

U.S. PATENT DOCUMENTS

| | | | |
|---|---|---|---|
| 1,014,004 | 1/1912 | Irwin | 248/102 |
| 1,187,845 | 6/1916 | Kolb | 248/102 |
| 1,188,904 | 6/1916 | Cosgriff | 248/102 |
| 1,559,740 | 11/1925 | Cardarella | 248/102 |
| 1,723,731 | 8/1929 | Hafling | 248/102 |
| 2,060,194 | 11/1936 | Gissubel | 248/102 |
| 2,494,632 | 1/1950 | Rodin | 248/102 |
| 2,545,414 | 3/1951 | Pittman | 248/104 |
| 2,579,701 | 12/1951 | Ridey | 248/102 |
| 2,907,539 | 10/1959 | Vardan | 248/104 |
| 2,919,874 | 1/1960 | Strong | 248/103 |
| 2,944,779 | 7/1960 | Silagyi | 248/103 |
| 3,000,384 | 9/1961 | Piers, Jr. | 128/DIG. 15 |
| 3,144,230 | 8/1964 | Brooks | 248/102 |
| 3,543,976 | 12/1970 | Ronald | 248/102 |
| 3,635,431 | 1/1972 | Mariner | 248/104 |
| 3,977,638 | 8/1976 | Woodard | 248/102 |
| 4,096,977 | 6/1978 | Barville | 248/102 |
| 4,220,302 | 9/1980 | Hampton | 224/148 |
| 4,386,723 | 6/1983 | Mule | 24/306 |
| 4,498,613 | 2/1985 | Donahue | 248/102 |
| 4,537,341 | 8/1985 | Kelly | 248/104 |
| 4,588,224 | 5/1986 | Hill, Jr. | 297/DIG. 6 |

FOREIGN PATENT DOCUMENTS

| | | | |
|---|---|---|---|
| 129883 | 11/1946 | Australia | 248/102 |

*Primary Examiner*—J. Franklin Foss
*Assistant Examiner*—Robert A. Olson

[57] ABSTRACT

A nursing bottle holder comprising body straps surrounding the bottle and a neck strap enclosing the neck of the bottle. Suspension straps are secured to the holder at upper and lower ends, and include fastening means to join the ends of the suspension strap together. A piece of hook and loop tape is slidingly engaged along the suspension strap, to engage a complementary portion of hook and loop tape provided on a car seat.

2 Claims, 3 Drawing Figures

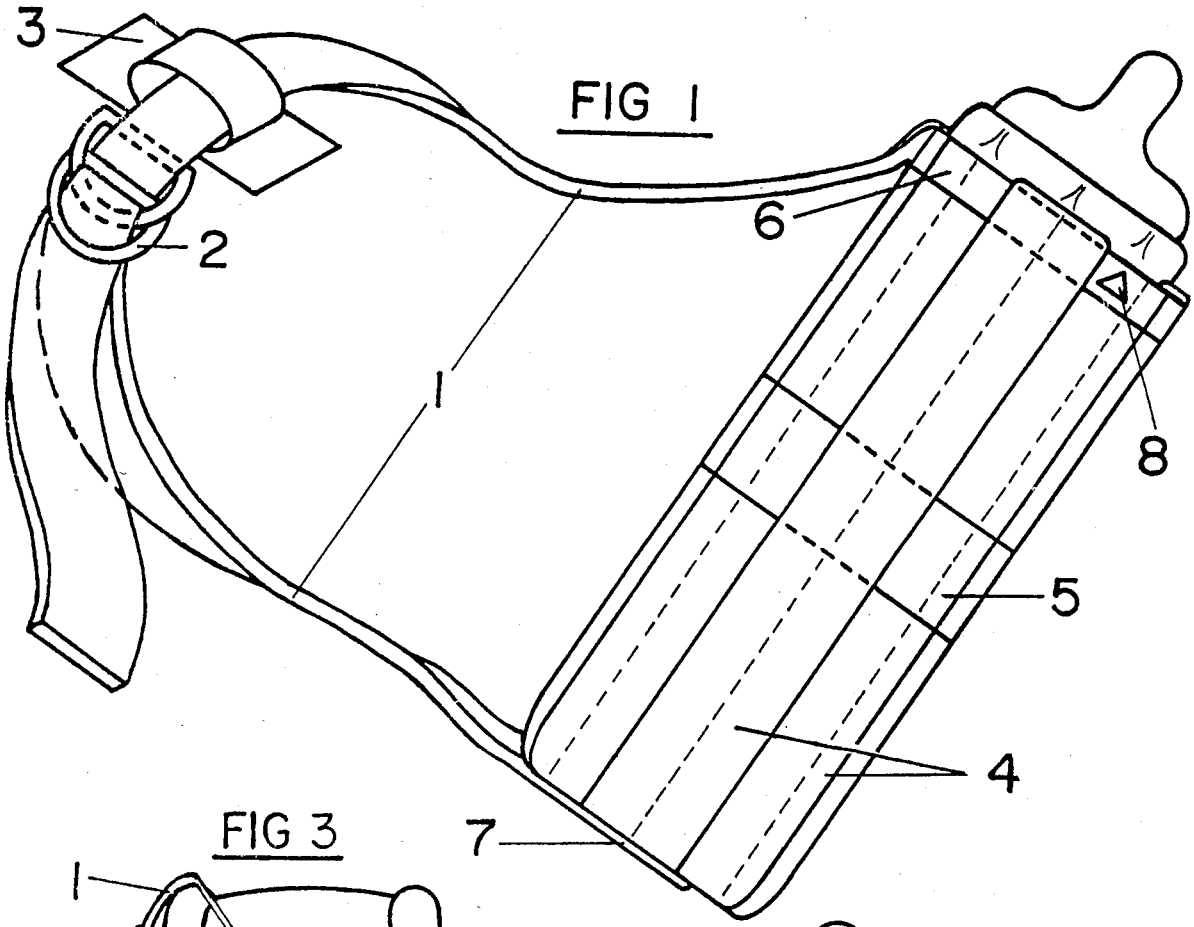
FIG 1
FIG 3
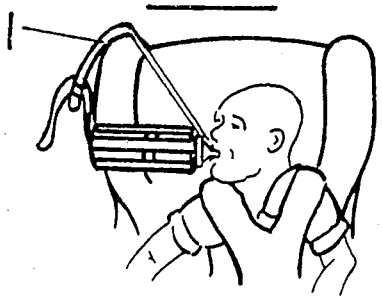
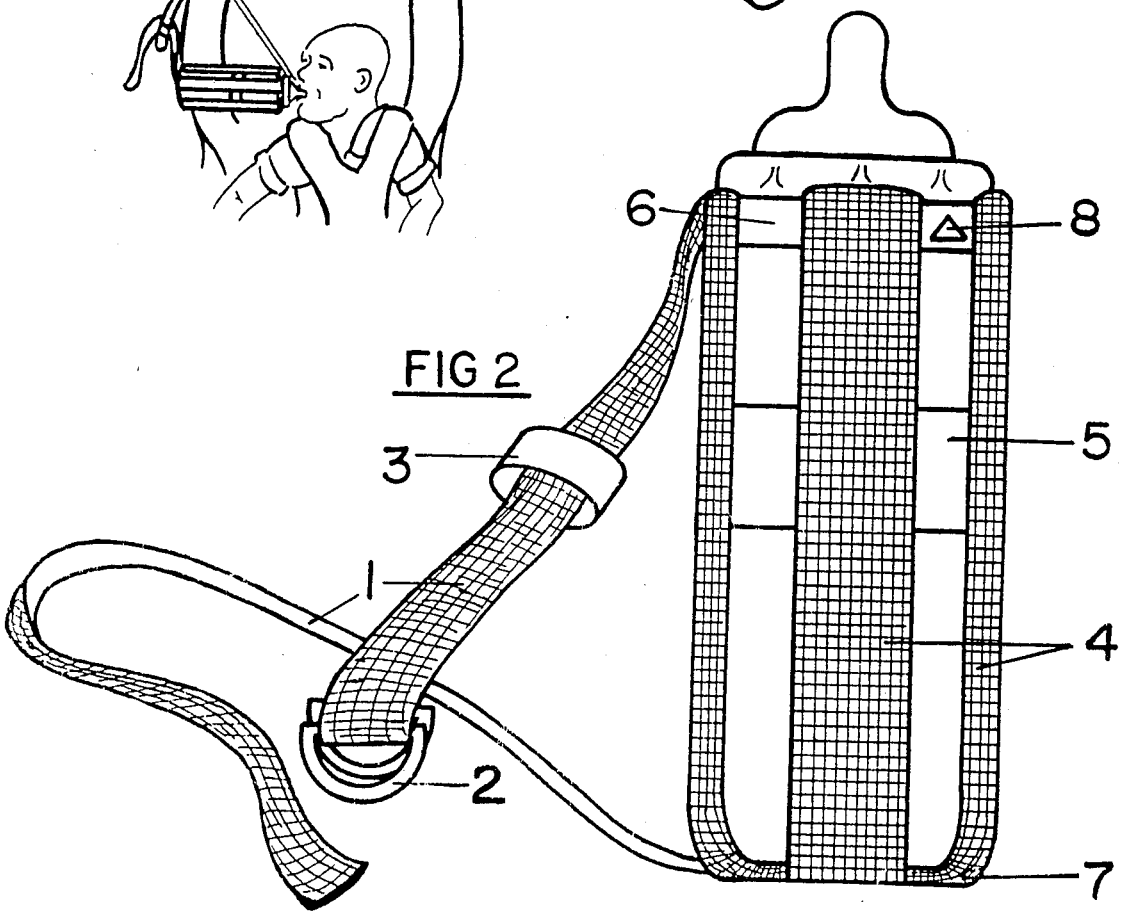
FIG 2

BOTTLE SLING FOR HOLDING A BABY BOTTLE WHILE TRAVELING

BACKGROUND OF THE INVENTION

This invention relates to the supporting, retaining, suspending and making accessable, a baby bottle to the infant with mimimal effort and exertion from the parent when the child is in an infant carrier or car-seat and is located in the vehicle and needs to be fed, allowing the infant to feed or drink at his or her leisure without the parent having to hold the bottle during the complete feeding process.

A major problem while traveling with an infant or infants is the constant need for the parent to lean over the top of the front seat to take care of an infant and hold the bottle while feeding the infant or bring them into the front seat unrestrained which is against the new child restraint laws now in effect in most states.

It is therefore the objective of the invention to alleviate these problems and to allow the parent to not only remain in the front seat without having to lean over the seat to hold the bottle, but also allows the parent and infant to remain in their respective restraint systems.

It is also an objective of this invention to adjust to all levels as to accomodate the size of the child from ages four months to two years or to an age that the bottle sling is no longer required.

These and other objectives will become apparent from the following description of the invention, the bottle sling.

SUMMARY OF THE INVENTION

The objectives of this invention are achieved by the bottle sling, consisting of material or straps running lengthwise from the bottom of the baby bottle to the neck or the threaded portion of the baby bottle and has a carefully fitted girdle strap in the middle portion of the bottle sling that is the same diameter as the base diameter of the baby bottle and is connected to the lengthwise straps. At the upper end, or the open end is another strap containing a snap closure to aid in the insertion and in retaining the bottle when in use, also connected to the lengthwise straps, but by means of loops in the ends of the straps, fastened back onto themselves. The neck strap is the same diameter as the neck or threaded portion of the baby bottle and retains the bottle in the bottle sling when it is in use. The lengthwise straps run the overall length of the bottle in a concentric pattern on four sides of the bottle with the girdle strap attached mid-way up the length of the bottle and the bottle sling, to maintain the conformity of the shape and structural integrity of the bottle sling. The suspension strap is attached to either end of the bottle sling, one at the base with no special features other than the length to specifications, the other is attached at the same level as the neck strap on the open end and contains a sliding piece of hook and loop tape and also has two 'D' rings fastened by means of a loop in the end of the strap fastened back onto itself, therey retaining the two 'D' rings in a permanent position. Both straps are fastened with the trailing end facing toward the middle of the bottle sling. The neck strap is held in place by means of a loop in the lengthwise straps fastened back onto themselves and contains a snap closure, and the strap is threaded through the apertures in the lengthwise straps. The hook and loop tape is in two pieces, the first located on the front of the two pieces of the suspension strap, in the shape of a ring the same diameter as the strap, but allowing it to slide the length of the strap, the other being an adhesive backed section to be fastened in the appropriate position on the child carrier or car-seat, on the upper right or left of the side head support of either, allowing easy placement or removal of the bottle sling as required by parent, child, or situation by means of the hook and loop tape.

THE DRAWING

A preferred embodiment of the invention is shown in the accompanying drawing which shows;

FIG. 1 A semi-transparent view of the overall design and configuration.

FIG. 2 A normal view of design, configuration and material.

FIG. 3 A view of the invention's placement and function.

DETAILED DESCRIPTION OF THE ILLUSTRATED EMBODIMENT

In FIG. 1 the suspension strap 1 is in two equal pieces with the first of the two attached to the bottom of the main body 7 and has no other special features other than the specified length. The other strap 1 has the same specified length but is attached to the front of the main body and has the trailing portion of the strap facing over the middle of the main body so as to make a complete suspension media for the bottle sling. The two free ends of the suspension strap are joined by the use of two 'D' rings 2 located on the suspension strap fastened to the front of the main body, and the 'D' rings are fastened in place by a loop in the strap fastened back onto itself. Also contained on this strap is a piece of hook and loop tape that is one of two pieces, one being sewn in the shape of a circle 3 and a counterpart of an adhesive backed portion of hook and loop tape, to fasten to the appropriate position on the car-seat. The first section of the hook and loop tape is allowed to slide freely along the length of the front suspension strap.

The main body 4 consists of two equal length straps with the apex at the bottom of the bottle sling proceeding concentrically and surrounding four sides of the bottle with a girdle strap 5 attached by stitching or rivets to the main body. Then the main body continues up the length of the bottle to the neck strap 6 and encircling the neck strap at each point of overlap and fastened back onto itself. The neck strap is the same diameter as the neck or threaded portion of the baby bottle and has a snap closure 8 to aid in the insertion and also the retaining of the baby bottle in the bottle sling when in use.

FIG. 2 shows the original conception of the stitched seams and overlap joints of material, and the construction of the main body, the girdle strap, the neck strap, the snap closure, and the suspension strap which contains the two 'D' rings and the hook and loop tape. The connecting points and direction of the suspension straps to the main body are shown.

FIG. 3 is a view of the installation and use of the bottle sling and the proper location for placement for the hook and loop tape with the adhesive backing.

What is claimed is:

1. A nursing bottle support comprising a series of equal length body straps joined together at the midpoints thereof and adapted to engage the sides of a nursing bottle, a neck strap joined to the ends of the body straps and including a closure means on the ends thereof so as to form a neck engaging portion, a pair of suspension straps with the first joined to the midpoint of the body straps and the second joined near the end of a body strap, strap fastening means on the ends of the suspension strap, and a piece of hook and loop tape joined in a circle, with the second suspension strap received through the circle so as to provide an adjustable car seat engaging means.

2. A nursing bottle support as defined in claim 1, and further including a girdle strap joined to the body straps between the neck strap and the midpoints of the body straps.

* * * * *